US009976829B2

(12) United States Patent
Yamin et al.

(10) Patent No.: US 9,976,829 B2
(45) Date of Patent: May 22, 2018

(54) FIRING PREVENTING AND STOPPAGE APPARATUS FOR REMOTELY OPERATED AUTOMATIC WEAPON

(71) Applicant: RAFAEL ADVANCED DEFENSE SYSTEMS LTD., Haifa (IL)

(72) Inventors: Amos Yamin, Kazir (IL); Moshe Arie, Binyamina (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days. days.

(21) Appl. No.: 14/655,254

(22) PCT Filed: Dec. 18, 2013

(86) PCT No.: PCT/IL2013/051031

§ 371 (c)(1),
(2) Date: Jun. 24, 2015

(87) PCT Pub. No.: WO2014/102771

PCT Pub. Date: Jul. 3, 2014

(65) Prior Publication Data

US 2015/0330735 A1 Nov. 19, 2015

(30) Foreign Application Priority Data

Dec. 27, 2012 (IL) ..... 223982

(51) Int. Cl.
*F41A 17/58* (2006.01)
*F41A 17/06* (2006.01)
(Continued)

(52) U.S. Cl.
CPC ..... *F41A 17/58* (2013.01); *F41A 17/06* (2013.01); *F41A 17/42* (2013.01); *F41A 19/58* (2013.01)

(58) Field of Classification Search
CPC ..... F41A 17/00; F41A 17/06; F41A 17/08; F41A 17/42–17/46; F41A 17/56–17/58; F41A 19/58
(Continued)

(56) References Cited

U.S. PATENT DOCUMENTS 2,948,192 A * 8/1960 Evans ..... F41A 19/59 89/28.05
3,731,588 A * 5/1973 Curtis ..... F41A 3/72 89/1.4
(Continued)

FOREIGN PATENT DOCUMENTS

DE 2403477 7/1975
DE 2403477 A1 * 7/1975 ..... F41A 17/06
(Continued)

*Primary Examiner* — Stephen Johnson
*Assistant Examiner* — Benjamin S Gomberg
(74) *Attorney, Agent, or Firm* — Rodney J. Fuller; Booth Udall Fuller, PLC

(57) ABSTRACT

Firing preventing and stoppage apparatus for remotely operated automatic weapon such as installable in RCWS (Remotely Controlled Weapon Station), that comprises a barrier component and an actuator connected to the barrier component, wherein the barrier component is suited to movement through a cartridges ejection port from an automatic weapon, to a movement path of the breech block of the weapon, for preventing in advance or stoppage of runaway firing from it, and outwards from it in a manner that enables firing, an RCWS equipped with such apparatus and a method for preventing and stopping runaway firing of automatic weapons that are mountable in an RCWS and comprises a breech block and a cartridges ejection port that is implemented in such apparatus.

9 Claims, 7 Drawing Sheets

Figure 1:
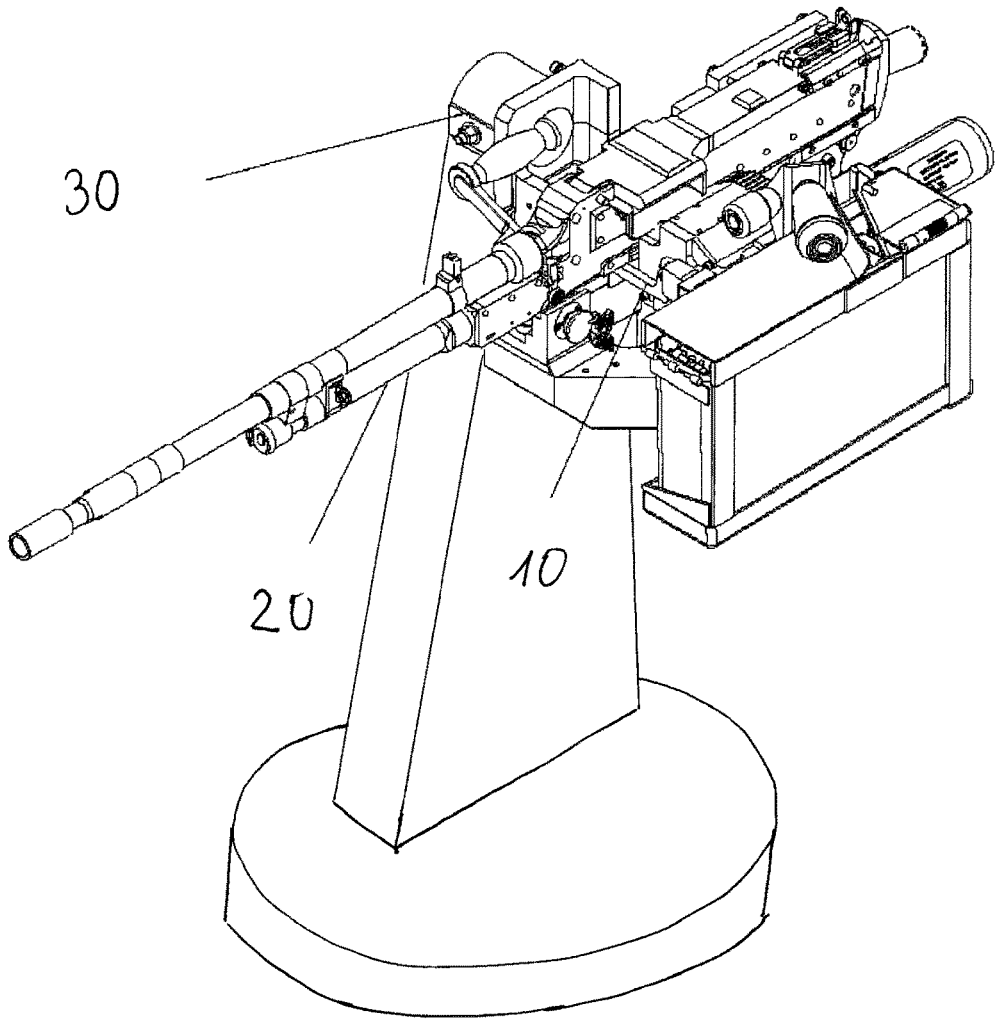

(51) Int. Cl.
*F41A 17/42* (2006.01)
*F41A 19/58* (2006.01)

(58) Field of Classification Search
USPC ..... 89/150
See application file for complete search history.

(56) References Cited

U.S. PATENT DOCUMENTS 3,821,920 A 7/1974 Brieger
3,961,555 A * 6/1976 Zellmer ..... F41A 17/06 102/262
4,699,040 A 10/1987 Menges
4,986,162 A 1/1991 Wissing
5,058,482 A 10/1991 Bartolles
5,127,309 A 7/1992 Menges
5,223,649 A 6/1993 Claridge
5,231,243 A 7/1993 Lescure
5,924,232 A 7/1999 Rhoden
6,694,659 B2 * 2/2004 Olsen ..... F41A 17/44 42/70.01
6,836,989 B2 1/2005 Gussalli Beretta
8,042,450 B2 * 10/2011 Doll ..... F41A 17/56 42/70.01
8,127,657 B2 * 3/2012 Gorali ..... F42C 15/42 42/70.04
8,448,557 B2 * 5/2013 Hamish ..... F41A 9/29 89/27.12
2010/0257769 A1 10/2010 Doll
2011/0296978 A1 12/2011 Hamish
2012/0090213 A1 4/2012 Pichler

FOREIGN PATENT DOCUMENTS

DE 3712905 11/1988
DE 9301594 5/1994
DE 10215910 10/2003
IL 176038 7/2007
JP H07-091890 4/1995

* cited by examiner

FIRING PREVENTING AND STOPPAGE APPARATUS FOR REMOTELY OPERATED AUTOMATIC WEAPON

CROSS-REFERENCE TO RELATED APPLICATIONS

This application is the U.S. National Stage of International Application No. PCT/IL2013/051031, filed Dec. 18, 2013, which claims the benefit of and priority to Israeli Application No. 223982, filed Dec. 27, 2012, the contents of each of which are hereby incorporated by reference in their entireties.

FIELD OF THE INVENTION

The invention, the subject matter of this patent application, is found in the field of apparatus that serve for prevention and stoppage of unintentional (unwanted) firing as it might occur from automatic weapons (for example—a machine gun) that is remotely operated, wherein it is installed in a Remotely Controlled Weapon Station—herein after RCWS.

BACKGROUND OF THE INVENTION

RCWS is a weapon (weaponry) station or post that is mostly mounted on military vehicles or armored combat vehicles and is controlled from within the vehicle by means of a joystick, video display and operating console. The RCWS comprises all the functions which enable it to acquire targets, aim the weapon and fire at a target with high accuracy. The gunner operates while he is within the vehicle and is protected by the vehicle's armor.

A typical weapon that is mounted in an RCWS is a machine gun (for example—Medium machine gun M-240g or an FN MAG58), that is fed by concatenated munitions ("belted") in the sense of a belt or of a metallic link chain and includes an ejection port through which the empty cartridges (bullet casings or cartridge cases) are ejected in the course of the firing progress.

In all the machine guns that we cited above, use was made of the pressure that was generated by initiating the bullets cartridges for reloading and re-cocking the machine gun (the well known principle of Maxim's gun). The machine guns can include various mechanisms for restraining the created force—recoil systems, blowback system and gas mechanisms. What is common to all of them is the development of a cyclic linear movement of a component of the machine gun forward and backward along the firing axis, as long as firing occurs (initiated or uncontrollable) from the machine gun). In a machine gun with a recoil system the moving component is the breech bolt, in a machine gun with a blowback system the moving component is the sliding block, and in a machine gun with a gas mechanism the moving component is the 'bolt'. Herein after all the moving components cited above will be dubbed 'breech block'. Posting a block (jam) and generating a mechanical obstruction in the path of the breech block movement prevents the possibility of firing from the machine gun, and in case of existence of firing—causes an immediate stoppage of the firing from the machine gun. An additional characteristic is the fact that a leading front edge of the breech block is exposed during its cyclic movement step over the ejection port of the cartridge cases.

Machine guns of the discussed type might suffer from a phenomenon of occurrence of continued runaway fire (spontaneous firing) also after releasing the machine gun's trigger (a phenomenon known also by its nicknames "unruly weapon" (also: "going wild weapon").

From the instant of mounting machine guns of the type discussed in the RCWS then the firing action (pressing the trigger) is executed by remote activation of a means that in fact imitates the operation done manually (pressing the trigger by the operator's hand/finger). For example—remote actuation by issuing an electrically command on an electro-mechanical means of—for example, the solenoids type. Under those circumstances, a scenario of continued spontaneous firing might lead to very serious results because of the far away location of the operating soldier (for example—inside within the armored vehicle on top of which the RCWS is mounted).

Not only the above, but also the following—exchanging the fighter's pressing finger—of a soldier that has self judgment and discretion, by an electro-mechanical actuator that exists as said at the contact point—namely at the pressing and releasing point of the trigger of the machine gun installed in the RCWS, also naturally adds an assembly that is susceptible for a technical failure, to the control chain over the machine gun's operation (an electro-mechanical actuator).

Thus, for machine guns that are remotely operated from the RCWS proper, there is required an apparatus, one or more, for early prevention and stoppage of not-intended (unwanted) firing, namely stoppage of runaway fire. An apparatus that would be also remotely operable in and of itself.

A publication of patent application IL 176038 by the applicant of this present (current) patent application, describes an electrically actuated apparatus for preventing unintentional firing. There, the subject presented is an electro-mechanical apparatus for remote operation of an integral safety catch of a machine gun. Naturally it is not talked there about an apparatus that prevents or stops runaway fire even after releasing the trigger of the machine gun.

A publication of patent application US 2011/0296978 by the applicant of this current patent application, describes a firing mechanism security apparatus for remotely controlled automatic machine guns. The subject discussed there is an apparatus such as that when an indication from two sensors, that point the existence of firing taking place without any given command to press the trigger, executes a mechanical intervention by posting an obstruction on the cartridges chain (for stopping the feeding of the machine gun), or alternatively—in a way of posting an obstruction to ejecting the empty cartridges from the ejection port (and hence generating a jam as a result). In addition, the publication describes also an option of automatic shifting of the faulty (out of order) machine gun and training (directing) it unto a safer elevation angle.

It has been found that there exists a need to add an apparatus that will prevent unintentional firing in advance and not only lead to stoppage of such unintentional firing from the instance of receiving the indications as said, about the fact that such firing actually exists.

This and more, as a backup and as an addition to the apparatus described there (in US 2011/0296978) or as an substitute to it, there exists a need that the stoppage of the firing would not be dependent on obstructing the path of the cartridges chain toward the machine gun (as indeed the cartridges belt might be torn in a manner that part of it would continue to feed the machine gun as it is pulled by it), or requires waiting to the actual formation of a stoppage (in the time interval that passes between obstructing the ejection port until the jam actually occurs).

In addition, from the instant of activating the apparatus of the type described there (in US 2011/0296978), then restoring the machine gun to normal operation condition, enforces a relatively long exposure of a soldier that is required to exit—for example, from the safety of the relative protection of the space of the armored vehicle (on which the RCWS is mounted) for installing anew the cartridges belt or clearing the jam that was made, a relatively long time consuming task, hence dangerous.

Thus, at the time that preceded the invention, the subject matter of this current patent application, a need was recognized for—at least, an additional apparatus, reliable and low priced, both for preventing of runaway fire as well as for stoppage of runaway fire at its nascent beginning as it is occurring at a machine gun that is remotely operated while mounted on an RCWS and that from the instant of its actuating would quickly and efficiently stop the firing from the machine gun, and in a manner that would enable proper renewed operation of the machine gun while not requiring extended exposure of the soldier.

SUMMARY OF THE INVENTION

The current invention, the subject matter of this patent application, responds to the need expressed above by providing an apparatus that from the instant of activating it, posts a mechanical interruption (a barrier) to the breech block (as defined previously above) of the machine gun, and prevents in advance or stops the cyclic linear movement forward and backward of the breech block which is required, as said, for executing automatic firing by the machine gun.

The barrier (jamming) component in an apparatus in accordance with the invention is inserted through the ejection port of the cartridges and makes a place for itself before the front leading edge of the breech block.

In one aspect, the invention is an apparatus that prevents and stops runaway firing—that is installable in the RCWS. An apparatus that comprises a barrier (jamming) component and an actuator that is connected to said barrier component. The barrier component is suited for movement by the actuator through the cartridges ejection port from automatic weapons that are mountable in an RCWS, to the weapon's breech block movement path, in order to prevent in advance or stop runaway firing from it, and outwards from it in a manner that enables firing.

In a preferred embodiment of the invention, the actuator is an electrical actuator that is activated to propel the barrier component outwards (away) from the breech block movement path, while in the regular (normal) situation the barrier component is spring biased toward the breech block movement path.

By the point of view of a second aspect, in the invention there is embodied a general method for preventing and stopping runaway firing of automatic weapons that are mountable in an RCWS and comprises a breech block and a cartridges ejection port. A method that comprises the steps of interrupting the movement of the breech block of the weapon by propelling a barrier component to move through the cartridges ejection port to the movement path of the breech block of the weapon for preventing in advance (before it starts) or stopping runaway firing of the weapon. At the second step the barrier component is propelled to movement through the cartridges ejection port outwards (away) from the movement path of the breech block in a manner that firing by the weapon is enabled.

It is to be understood that both the foregoing general description and the following detailed description are exemplary and explanatory and are intended to provide further explanations of the invention as claimed.

BRIEF DESCRIPTION OF THE ACCOMPANYING DRAWINGS

Examples illustrative of embodiments of the invention are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale.

FIG. 1 constitutes a view in perspective of an RCWS in which a machine gun with a preventing and stopping runaway firing apparatuses in accordance with the invention is installed.

Figure 2:
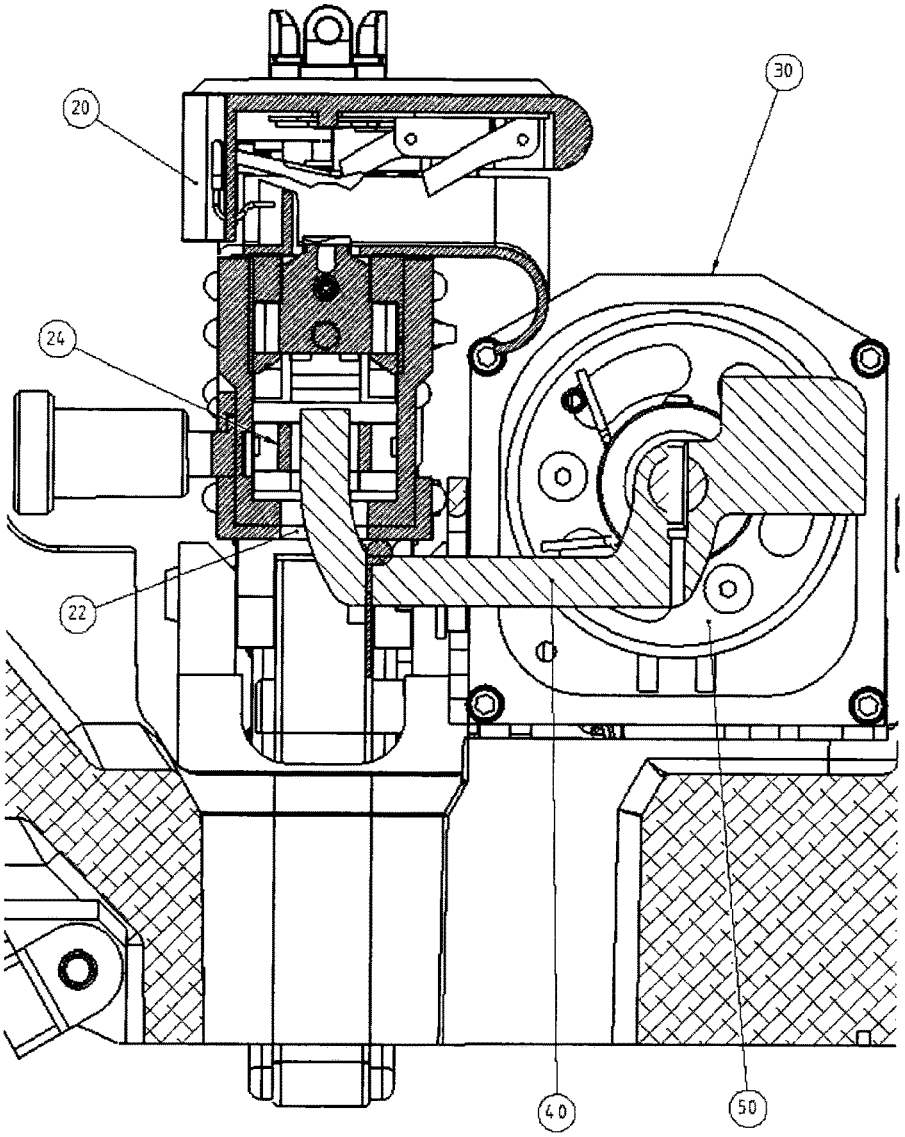

FIG. 2 constitutes a cross section view of the RCWS that is illustrated in FIG. 1, wherein the apparatus is in the condition of prevention and stoppage of runaway firing.

Figure 3:
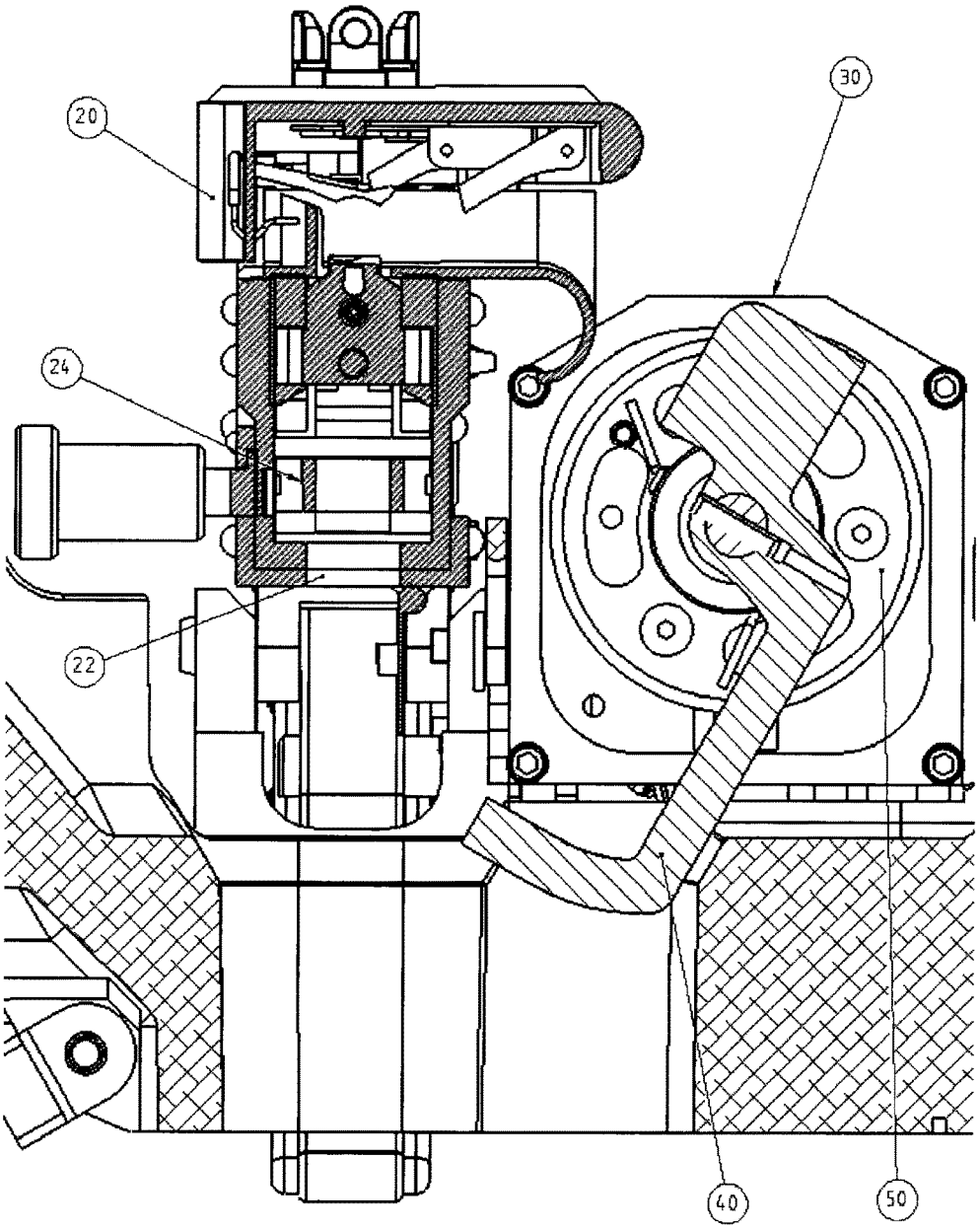

FIG. 3 constitutes a cross section view of the RCWS illustrated in FIG. 1, wherein the apparatus is found in a condition that enables firing.

Figure 4:
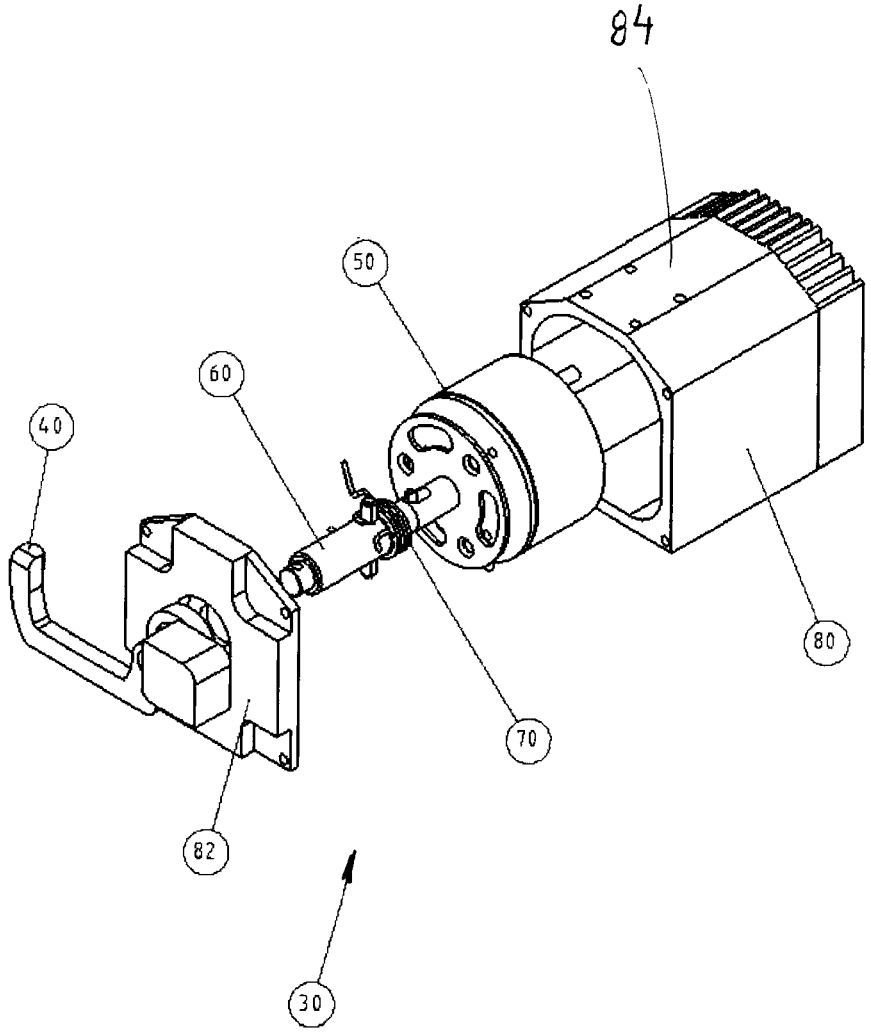

FIG. 4 constitutes an exploded view of the components of an example apparatus in accordance with the invention.

Figure 5:
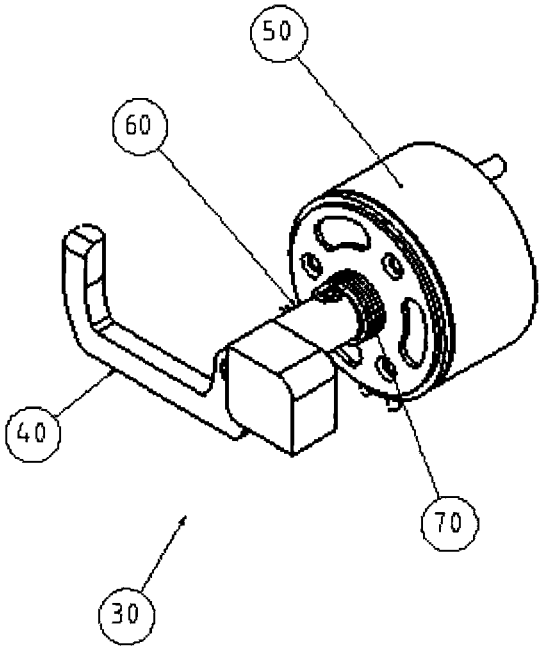

FIG. 5 constitutes a view in perspective of an example of the apparatus whose components are illustrated in FIG. 4, except for the house component and the various packaging and anchoring components, wherein the apparatus is found in the condition of prevention and stoppage of runaway firing.

Figure 6:
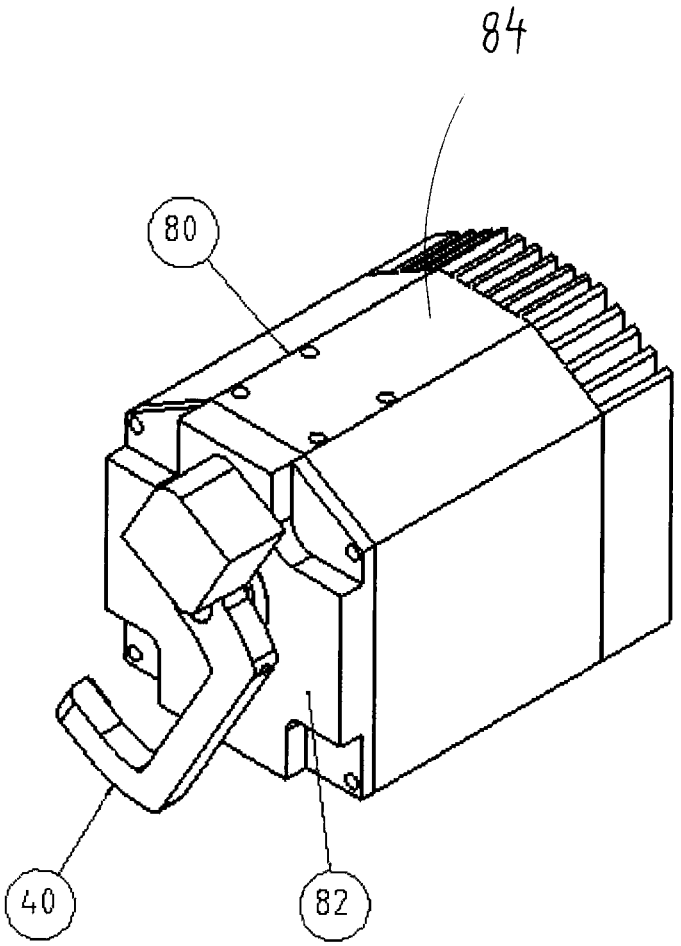

FIG. 6 constitutes a view in perspective of an example of the apparatus whose components are illustrated in FIG. 4, wherein the apparatus is found in a condition that enables firing.

Figure 7:
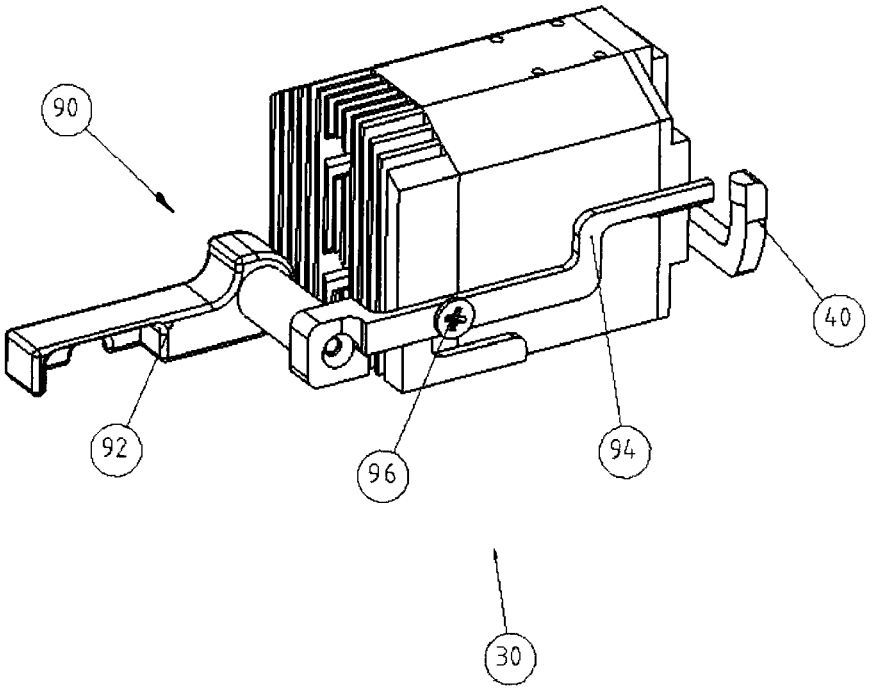

FIG. 7 constitutes a perspective view of an example of the apparatus whose components are illustrated in FIG. 4, with the addition of means for an alternative manual extraction of the barrier component.

DETAILED DESCRIPTION OF AN EMBODIMENT EXAMPLE OF THE INVENTION

Reference is made to FIGS. 1 to 3. FIG. 1 is a view in perspective of an RCWS 10 in which a machine gun 20 (in the illustrated example—Medium machine gun M-240g or FN MAG58) with a preventing and stopping runaway firing apparatus 30 in accordance with the invention is installed. FIG. 2 constitutes a cross section view of RCWS 10 wherein apparatus 30 is found in the condition of prevention and stoppage of runaway firing. FIG. 3 constitutes a cross section view of RCWS 10 wherein apparatus 30 is found in a condition that enables firing.

Preventing and stopping runaway firing apparatus 30 comprises a barrier (jamming) component 40 and electrical actuator 50 that is connected to barrier component 40. Thus, the discussed subject is an electro mechanical mechanism that includes an electrical actuator unto which a rigid arm is connected. This is a compact mechanism in its dimensions (see FIG. 1) that enables its convenient packaging on the RCWS.

In accordance with the invention, barrier component 40 is suited to move through cartridges ejection port (opening) 22 of machine gun 20, unto the movement path of breech block 24 of machine gun 20 for preventing in advance of runaway firing from it or stoppage of such firing when its just beginning (see FIG. 2). This is the regular state of affairs of apparatus 30 (the default condition/situation), in which the rigid arm (barrier 40) is integrated with the movement path of the breech block of the automatic weapon and prevents the occurrence of firing, by posting a mechanical obstacle (barrier) to the linear movement of the breech block (non fire condition). Transition of apparatus 30 from the regular state (non fire condition) to a condition that enables firing (fire state), (see FIG. 3) is taking place from the instant of extracting barrier component 40 unto the outside of cartridges ejection port 22 and hence removing the mechanical obstruction that hinders the movement of the breech block to its forward position in which firing of the bullet occurs and complete evacuation of the cartridges ejection port 22 as is required for free ejection of the cartridges.

The transition from the state of non-fire position—see there, (FIG. 2) to the fire state (FIG. 3) and holding barrier component 40 as long as the firing continues, requires continuous activation of electrical actuator 50 by giving a suiting command and continuous current supply. In contra distinction to this, as we will see below, transition from firing state (FIG. 3) to firing stoppage state (FIG. 2) is automatic—from the instant of stopping the electrical actuator, barrier component 40 will be propelled persistently and continuously towards the movement path of the breech block of the weapon, and would strive to integrate anew into it and to post again a mechanical obstruction (jam) to its movement (in a manner that immediately halts the firing).

Reference is made to FIGS. 4 to 6. FIG. 4 constitutes an exploded view of the components of an example apparatus 30 in accordance with the invention. FIG. 5 constitutes a view in perspective of apparatus 30 wherein the device is illustrated without its housing and the various packaging and anchoring components, and the apparatus is found in the condition of prevention and stoppage of runaway firing (non fire condition). FIG. 6 constitutes a view in perspective of apparatus 30 wherein device 30 is found in a state that enables firing (fire state).

Apparatus 30 comprises, as said, a barrier component 40 and an electrical actuator 50 that is connected to barrier component 40. Barrier component 40 is made of a rigid material (for example from steel, by machining) in a configuration resembling the letter U shape. Linking barrier component 40 to electrical actuator 50 is performed by a rotation axis assembly 60. One end of barrier component 40 is suited to connect to rotation axis assembly 60 whereas the other end of barrier component 40 is suited for passage through the cartridges ejection port opening 22 (see FIGS. 2 and 3).

Electrical actuator 50 performs a rotational motion along an angular sector in a manner that the motion of barrier component 40 through cartridges ejection port 22 constitutes a rotational motion. Electrical actuator 50 that performs a rotational motion as said, might be, for example, a rotary solenoid manufactured by Shindengen Electric Co. model M700-21-178R or any equivalent rotary solenoid of similar properties and parameters that produces rotational motion along an angular sector.

Torsion spring component 70 that is connected to rotation axis assembly 60, in its regular state, biases barrier component 40 unto a rotational motion towards the movement path of the breech block of the weapon (see FIG. 2), but from the instant of actuating electrical actuator 50 and turning rotation axis assembly 60 against spring 70, exit of barrier component 40 outwards is enabled also by a rotary movement as said, through the cartridges ejection port 22 and evacuating the motion path of the breech block (see FIG. 3).

Any professional would understand that propelling the barrier component in an apparatus in accordance with the invention into a motion that is rather rotary in its direction, as it is happening at apparatus 30, constitutes only one possibility, and in an apparatus in accordance with the invention the barrier component can be propelled into a motion that is rather linear in its direction (to differentiate it from the rotary one as described above when referring to the accompanying drawings).

Any professional would also understand that apparatus 30 includes in addition also components that serve for packaging the apparatus components as they were described above into one and unified assembly and for anchoring the apparatus in the RCWS (see for example house component 80, front cover 82 and anchoring bracket 84).

Thus, any professional would appreciate the fact that in view of the regular state of apparatus 30 (spring 70 biasing barrier component 40 inwards, while electrical actuator 50 is idle), then—if the breech block of the weapon is found in its rear state but is released and—for any reason executes a non intended movement to the firing state (forward movement), the barrier component will stop the breech block and prevent in advance runaway firing. If it so happens that non intended firing is in progress (the weapon fires continuously) then barrier component 40 would automatically integrate for stopping the breech block movement (the leading front edge of the breech block would collide with barrier component 40 that would be pushed persistently and continuously by the power of return spring 70 and integrate by protrudes to its path), and thus perform immediate stoppage of the nascent unintended firing.

Reference is made to FIG. 7. FIG. 7 constitutes a perspective view of apparatus 30 with the addition of means 90 for an alternative manual extraction of barrier component 40 away (out) from the movement path of the breech block of the weapon. In the illustrated example, means 90 comprises a manual actuation handle 92 that is connected at its one side 94 to cited barrier component 40 (the end of the actuation handle is located within the letter U shaped structure of barrier component 40). Rotation axis 96 is located along the actuation handle. Turning said actuation handle 92 (manually and in the clock's direction) around turning axis 96, biases barrier component 40 into a rotational movement in a manner that rotation axis 60 (see FIGS. 4 to 6) turns against return spring component 70, and manual extraction of barrier component 40 is enabled (even without actuation of electrical actuator 50) away (outwards) from the movement path of the breech block and transition to the fire mode (fire state) is therefore manually achieved.

Any professional would understand that means 90 for manual extraction of barrier component 40, away (outwards) from the movement path of the breech block of the weapon is liable to include a return spring component positioned around rotation axis 96, in a manner that from the instant of releasing the handle, barrier component 40 would return and be biased unto the movement path of the breech block (by the power of return spring component 70), (see FIGS. 4 to 6).

Thus, as we pointed at above, transition from the non-fire state (FIG. 2) to the fire state (FIG. 3), and holding barrier component 40 as long as the firing continues, requires continuous actuation of electrical actuator 50 by providing a suitable command and maintaining a continuous current supply, or—alternatively, in accordance with the example that is illustrated in FIG. 7, in case of need—manual actuation of the alternate means for manual extraction of a barrier component and extracting it manually from the movement path of the breech block of the weapon.

Any professional would also understand that the invention can be implemented without an electrical actuator at all but with solely a manual actuator that would enable taking out the barrier component and extracting it from the movement path of the breech block of the weapon.

But, as usual, propelling the barrier component outwards and extracting it from the cartridges ejection port in a manner that enables firing (fire state) can be executed by electrical initiation of the electrical actuator, and this when a firing command is given, that can be the same command proper that causes also electrical initiating of the actuator of the weapon's trigger. In other words—the transition from the non-fire state (FIG. 2) to the fire state (FIG. 3), is executed when a current command is given to the electrical actuator, a current command that might be the same command itself that causes in parallel (or after a short pause, as is required for terminating the extraction of the barrier component), for actuating another electro mechanical actuator that simulates the operation of the soldier finger and executes the pressing on the machine gun's trigger for executing a desired and intended firing.

Any professional would also understand that for controlling an apparatus in accordance with the invention it is possible to integrate an array of sensors as described in patent application publication US 2011/0296978 that we pointed at above. When an indication from two sensors is given, that indicates (points at) the existence of actual firing without a given firing command of pressing on the trigger, automatic cut off of the power supply to the electrical actuator of an apparatus in accordance with the invention would be executed and the barrier component would be automatically biased to move toward the movement path of the breech block component of the weapon and bring about stoppage of the firing from it (in addition and similarly to what is described in the cited document, it is also possible to execute automatic diversion of the faulty weapon and training it to a safer and higher elevation angle).

In light of what was described above while referring to the accompanying drawings, any professional would appreciate the fact that in the manner of operation of apparatus 30, there is also embedded a general method for preventing and stopping runaway firing from automatic weapons that are mountable on an RCWS and includes a breech block and an opening for ejection of cartridges (cartridges ejection port). A method that comprises the step of interrupting the movement of the breech block of the weapon by propelling a barrier component to move through the cartridges ejection port to the movement path of the breech block of the weapon for preventing in advance (before it starts) or stopping runaway firing of the weapon (non-fire state).

At the second step, when it is wanted to transit from the non fire state to the fire state, the barrier component is propelled to movement through the cartridges ejection port outwards (away) from the movement path of the breech block in a manner that firing by the weapon is enabled.

In a preferred embodiment of the method, the propelling of the barrier component is characterized by that it is a rotational movement taking place along an angular sector.

Thus, the invention enables both prevention in advance of non intended firing (as long as the breech block is found in its rear position (state) and integration with the barrier component was enabled), and also stoppage of nascent un-wanted firing if it exists (through the regular biased state of the barrier component—to integrate into the movement path of the breech block).

The invention was described above while referring to a medium machine gun of the medium machine gun M-240g type or an FN MAG 58 type, but any professional would understand that what is treated is an apparatus that is suitable to be implemented in all automatic weapons that have an opening that enables access and passage through it unto the path of the cyclic movement—forward and backward, of the breech block of that weapon.

It is also to be noted that an RCWS in which an apparatus in accordance with the invention is mounted or on which an apparatus is implemented the prevention and the stoppage method of unintended firing in accordance with the invention, can be installed on marine propelled platforms as well as on static (military) posts and not only on armored vehicles as described above (in length—solely as an example). This and more, any professional would also understand that an apparatus in accordance with the invention is suitable for other implementations also in devices of automatic weapons as said, that are not necessarily RCWS's but in which electrical firing is implemented (for example—a machine gun mounting in a tank).

While the above description contains many specifications, the professional reader should not construe these as limitations on the scope of the firing preventing and stoppage apparatus which is the subject matter of the invention, but rather examples of embodiments thereof. It will be apparent to those skilled in the art of designing and manufacturing RCWS units, various modification and variations can be made in the firing preventing and stoppage apparatus of the present invention without departing from the spirit or the scope of the invention. Thus, it is intended that the present invention cover modifications and variations that come under the scope of the following claims and their equivalents.

The invention claimed is:

1. A preventing and stoppage apparatus of unintended firing that is installable in a remotely controlled weapon station (RCWS), that comprises:

a barrier configured for rotational movement into and through a cartridges ejection port of an automatic weapon that is installable in the RCWS, to a movement path of a breech block of said weapon, for preventing in advance or stoppage of runaway firing from said weapon, and outwards from said weapon in a manner that enables firing;

an electrical actuator connected to said barrier;

a rotation axis assembly that connects said barrier to said electrical actuator which has a rotational movement along an angular sector, in a manner that said rotational movement of the barrier through said cartridges ejection port is in response to the rotational movement of the rotation axis assembly;

a spring that is connected to and torsionally biased about said rotation axis assembly, having a regular state biasing said barrier toward said movement path of the breech block of said weapon; wherein actuating said electrical actuator causes rotation of said rotation axis assembly against said spring, and enables exit of said barrier away from said movement path of the breech block; and a means for alternative manual extraction of said barrier away from the movement path of said weapon's breech block, comprising:

a manual actuation handle connected on one side to said barrier; and a rotation axis located along said manual actuating handle;

wherein turning of said manual actuating handle around said rotation axis causes the barrier to rotate against the torsional bias of said spring and enables exit of said barrier away from said movement path of the breech block; and wherein rotating the barrier away in the manner that enables firing is executed through electrical initiation of said electrical actuator as part of a firing command that also causes electrical initiation of another electrical actuator of a trigger in said weapon.

2. A remotely controlled weapon station (RCWS) comprising a preventing and stoppage apparatus in accordance with claim 1.

3. A method for preventing and stopping runaway firing of an automatic weapon that is mountable in a remotely controlled weapon station (RCWS) and that comprises a breech block and a cartridges ejection port, wherein the method comprises the steps of:

interrupting a movement of said breech block of the weapon by propelling a barrier to rotate through the cartridges ejection port to a movement path of said breech block of the weapon for preventing in advance or stopping runaway firing of the weapon; and propelling the barrier to rotate through the cartridges ejection port away from the movement path of said breech block in a manner that firing by the weapon is enabled;

wherein the step of propelling the barrier to rotate through the cartridges ejection port away from the movement path comprises a rotational movement of the barrier taking place along an angular section and contrary to a torsional bias of a spring that is connected to and torsionally biased about a rotation axis assembly connected to the barrier.

4. A remotely controlled weapon station (RCWS) comprising a system that prevents or stops unintended firing from at least one automatic weapon, wherein the system is configured to implement the method in accordance with claim 3.

5. A preventing and stoppage apparatus of uninterrupted firing that is installable in a remotely controlled weapon station (RCWS), that comprises:

a barrier;

an electrical actuator connected to said barrier, wherein the actuator is configured to rotate the barrier into a cartridges ejection port of an automatic weapon that is installable in the RCWS, the rotation positioning the barrier into a movement path of a breech block of said weapon, thereby stopping runaway firing from said weapon;

a rotation axis assembly that connects said barrier to said electrical actuator which has a rotational movement along an angular sector, the rotation axis assembly being configured so that rotational movement of the barrier through said cartridges ejection port is in response to the rotational movement of the rotation axis assembly; and a spring connected to and torsionally biased about said rotation axis assembly, having a regular state biasing said barrier toward said movement path of the breech block of said weapon; whereby upon actuating said electrical actuator and rotation of said rotation axis assembly against said spring, said barrier moves away from said movement path of the breech block and exits the cartridges ejection port.

6. The apparatus in accordance with claim 5, wherein the apparatus further comprises: means for alternative manual extraction of said barrier away from the movement path of said breech block of said weapon.

7. The apparatus in accordance with claim 6, wherein said means for manual extraction of the barrier comprises:

a manual actuation handle having one side connected to said barrier; and a rotation axis located along said manual actuating handle;

wherein turning of said manual actuating handle around said rotation axis causes the barrier to rotate against the torsional bias of said spring and enables exit of said barrier away from said movement path of the breech block.

8. The apparatus in accordance with claim 5, wherein a firing command to trigger said weapon also enables said electrical actuator by electrical initiation of said electrical actuator to move the barrier away from said movement path of the breech block.

9. A remotely controlled weapon station (RCWS) comprising a preventing and stoppage apparatus in accordance with claim 5.

* * * * *